US005671931A

United States Patent [19]

Su

[11] Patent Number: 5,671,931

[45] Date of Patent: Sep. 30, 1997

[54] ROLLER SKATE

[76] Inventor: Hui-Chin Su, 28, Lane 349, Fan-An Road, Chia-Yi City, Taiwan

[21] Appl. No.: 651,145

[22] Filed: May 21, 1996

[51] Int. Cl.[6] ..... A63C 17/04

[52] U.S. Cl. ..... 280/11.22; 280/11.19

[58] Field of Search ..... 280/11.22, 11.21, 280/11.19, 844, 11.115

[56] References Cited

U.S. PATENT DOCUMENTS

| | | | |
|---|---|---|---|
| 1,868,548 | 7/1932 | Turner | 280/11.22 |
| 5,413,380 | 5/1995 | Fernandez | 280/11.19 |

FOREIGN PATENT DOCUMENTS

| | | | |
|---|---|---|---|
| 99784 | 6/1923 | Switzerland | 280/11.115 |
| 6749 | 3/1900 | United Kingdom | 280/11.22 |

*Primary Examiner*—Eric D. Culbreth

*Attorney, Agent, or Firm*—Larson and Taylor

[57] ABSTRACT

A roller skate includes three or more wheels rotatably supported in the lower portion. The front wheel is disengaged from the ground surface when the middle wheel and the rear wheel are in contact with the ground surface, and the rear wheel is disengaged from the ground surface when the middle wheel and the front wheel are in contact with the ground surface. The rear wheel is coupled to the front wheel so as to be driven by the front wheel when the rear wheel is elevated and is not in contact with the ground surface.

2 Claims, 4 Drawing Sheets

ROLLER SKATE

BACKGROUND OF THE INVENTION

1. Field of the Invention

The present invention relates to a roller skate, and more particularly to a roller skate having wheels coupled together.

2. Description of the Prior Art

Typical in line roller skates comprise four wheels provided in the bottom portion and arranged in a line. The bottom portions of the wheels are aligned with each other such that the four wheels may contact with the ground simultaneously. It is difficult to stand up or to operate the roller skate with only one wheel.

The present invention has arisen to mitigate and/or obviate the afore-described disadvantages of the conventional roller skates.

SUMMARY OF THE INVENTION

The primary objective of the present invention is to provide a roller skate including a rear wheel that may be driven by the front wheel when the rear wheel is elevated and when the rear wheel is not in contact with the ground.

In accordance with one aspect of the invention, there is provided a roller skate comprising a body including a lower portion, a front shaft, at least one middle shaft and a rear shaft rotatably supported in the lower portion of the body, a front wheel, at least one middle wheel and a rear wheel secured to the front shaft and the middle shaft and the rear shaft respectively for engaging with a ground surface, the front wheel being arranged to be disengaged from the ground surface when the middle wheel and the rear wheel are in contact with the ground surface, and the rear wheel being arranged to be disengaged from the ground surface when the middle wheel and the front wheel are in contact with the ground surface, and means for coupling the rear wheel to the front wheel so as to allow the rear wheel to be driven by the front wheel when the rear wheel is elevated.

The coupling means includes a first sprocket secured to the front shaft so as to be moved in concert with the front wheel, a second sprocket secured to the rear wheel so as to be moved in concert with the rear wheel, and a chain coupling the first and the second sprockets together so as to couple the front wheel and the rear wheel together.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
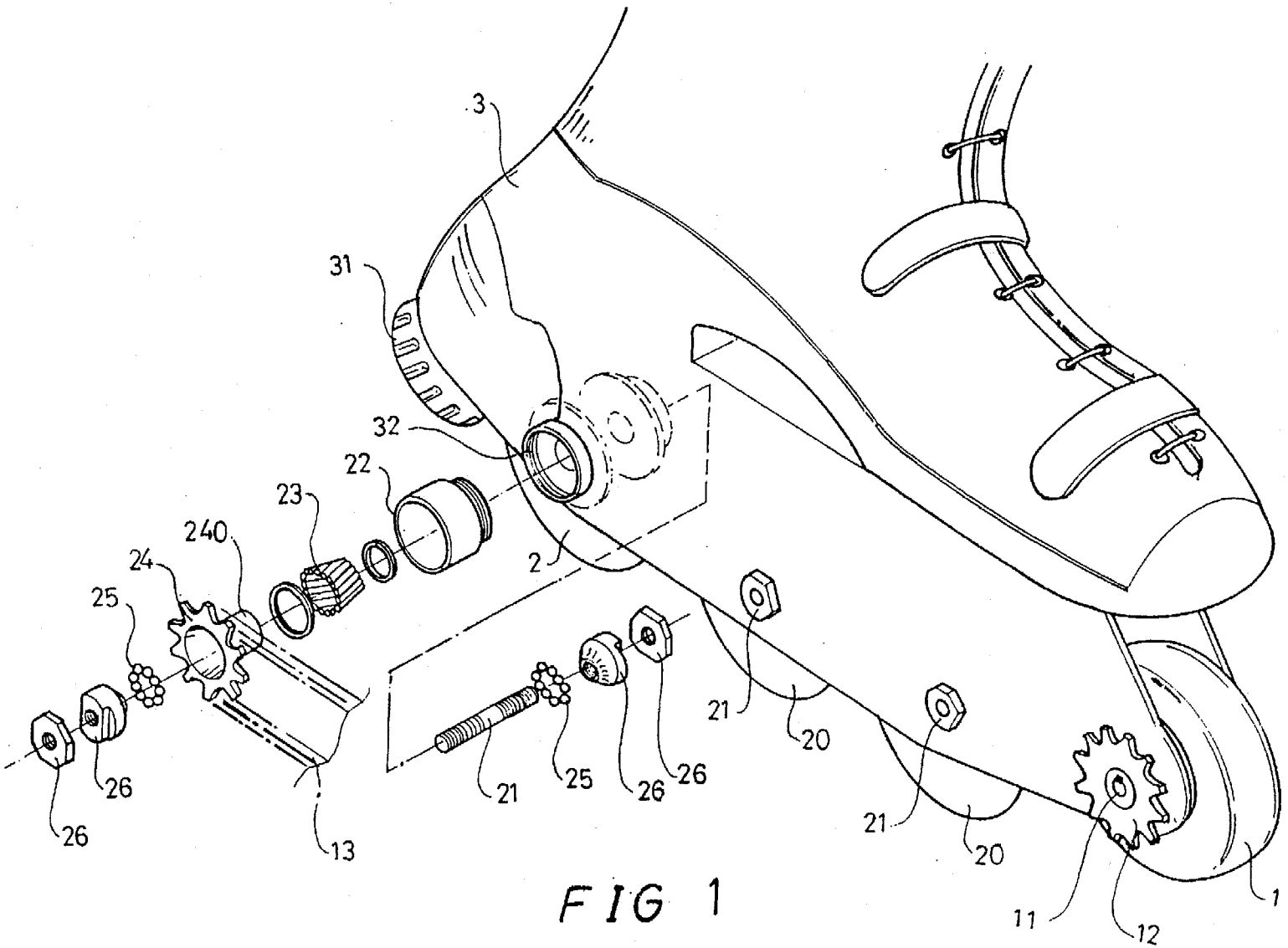
FIG. 1 is an exploded view of a roller skate in accordance with the present invention.
Figure 2:
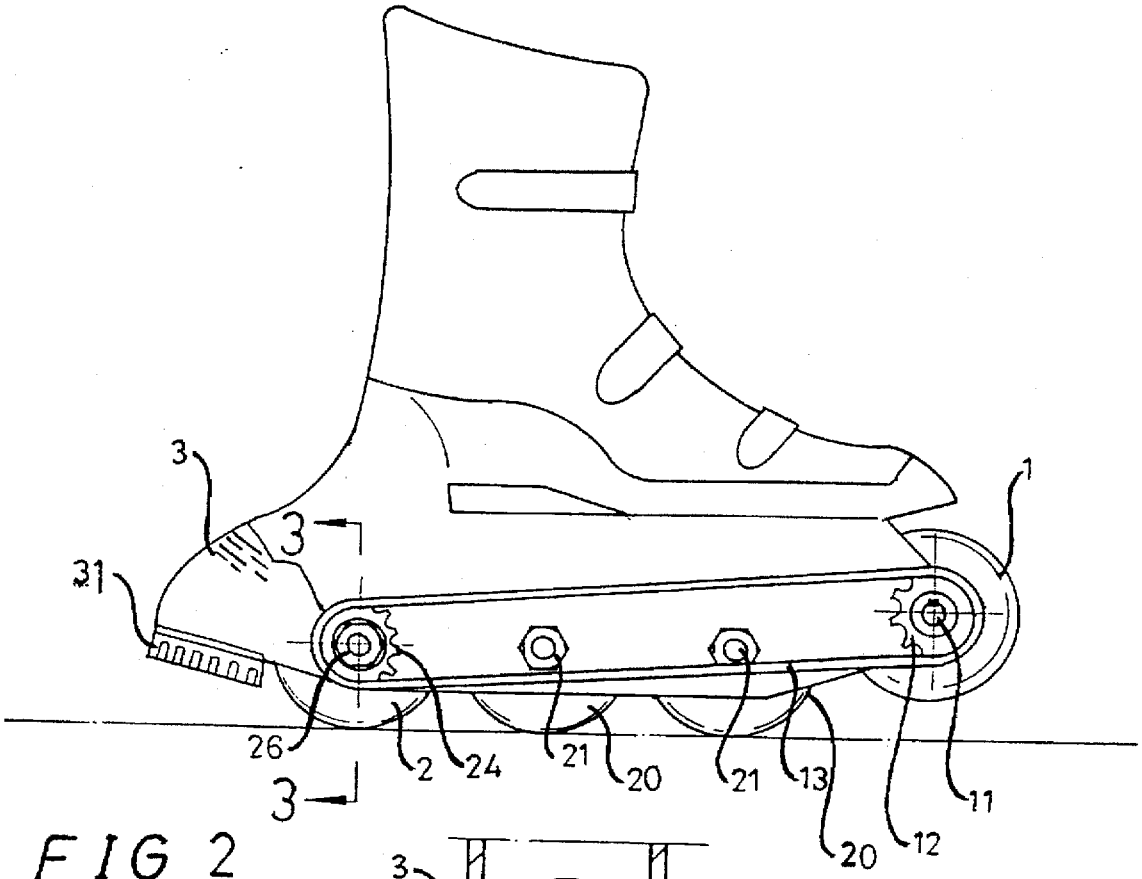
FIG. 2 is a side view of the roller skate.
Figure 3:
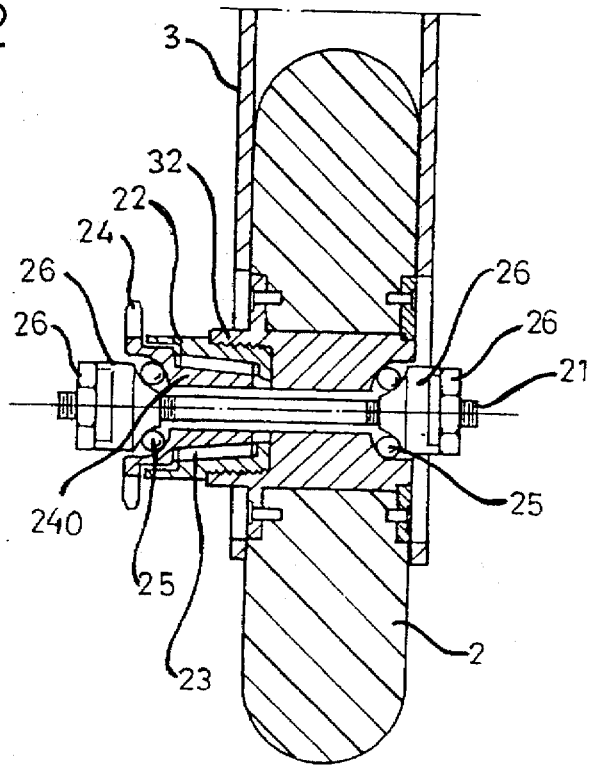
FIG. 3 is a cross sectional view taken along lines 3—3 of FIG. 2.

Referring to the drawings, and initially to FIGS. 1 to 3, a roller skate in accordance with the present invention comprises a body 3 including an upper shoe portion for engaging with the foot of the user and including a lower portion having four shafts 11, 21 laterally provided therein. A pad 31 is secured to the rear portion of the lower portion of the body 3 and is provided for braking purposes. A front wheel 1 is secured to the front shaft 11. A sprocket 12 is secured to the front shaft 11 and is moved in concert with the front wheel 1. Two middle wheels 20 are secured to two middle shafts 21 so as to be rotated about the shafts 21 respectively. The body 3 includes a hub 32 rotatably supported in the rear portion of the lower portion for receiving the rear shaft 21 therein. The rear wheel 2 is secured to the hub 32 and rotated in concert with the hub 32. A sleeve 22 includes one end threadedly engaged with the hub 32 so as to be secured to the hub 32, best shown in FIG. 3. A sprocket 24 includes a tube 240 rotatably engaged on the rear shaft 21 by a roller bearing 25. A plurality of rollers 23 are engaged between the sleeve 22 and the tube 240 of the sprocket 24 and are arranged to allow the sprocket 24 to be rotated in one direction relative to the sleeve 22 only, such that the rear wheel 2 may be driven to rotate in one direction by the sprocket 24. A number of fastening nuts 26 are engaged to the end portions of the rear shaft 21 so as to retain the rear shaft 21 and the sprocket 24 in place. A chain 13 is engaged with the sprockets 12 and 24 so as to couple the rear wheel 2 to the front wheel 1.

Figure 4:
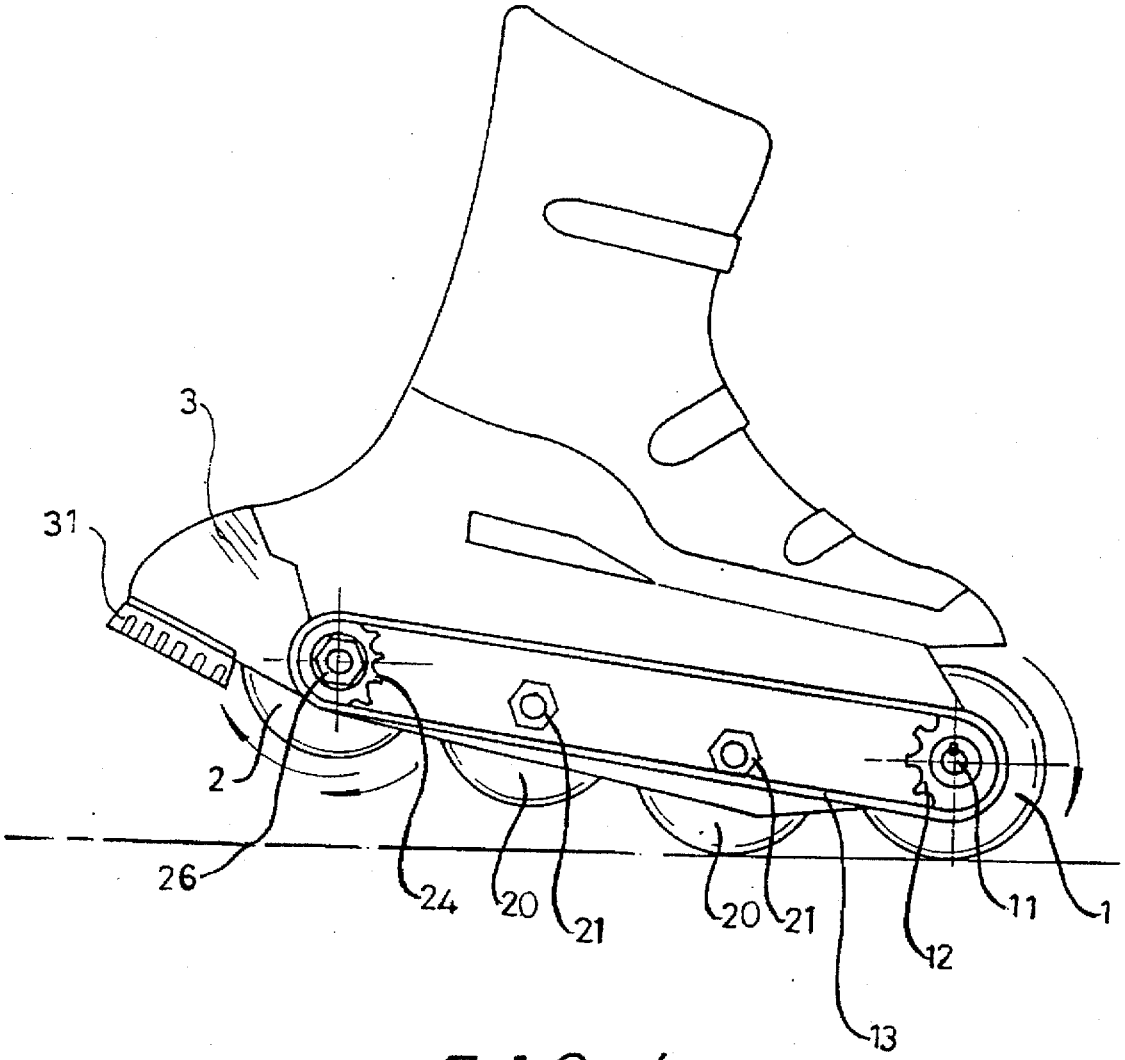
FIG. 4 is a side view illustrating the operation of the roller skate.

In operation, as shown in FIG. 4, when the user inclines forward so as to incline the roller skate forward, one of the middle wheels 20 and the front wheel 1 are caused to contact with the ground such that the rear wheel 2 is elevated. However, the sprockets 24, 12 are coupled together by the chain 13, such that the rear wheel 2 may be rotated by the front wheel 1 when the rear wheel 2 is elevated. Accordingly, when the user inclines backward again so as to incline the roller skate backward again in order to contact the rear wheel 2 and the middle wheels 20 with the ground, as shown in FIG. 2, the rear wheel 2 may rotate in a rotational speed substantially equals to that of the middle wheel 20 such that the rear wheel 2 will not decrease the moving speed of the roller skate. If the rear wheel 2 is not rotated by the front wheel 1, the rear wheel 2 should be rotated by the ground relatively when the rear wheel 2 contacts the ground, such that the moving speed of the roller skate will be decreased.

Figure 5:
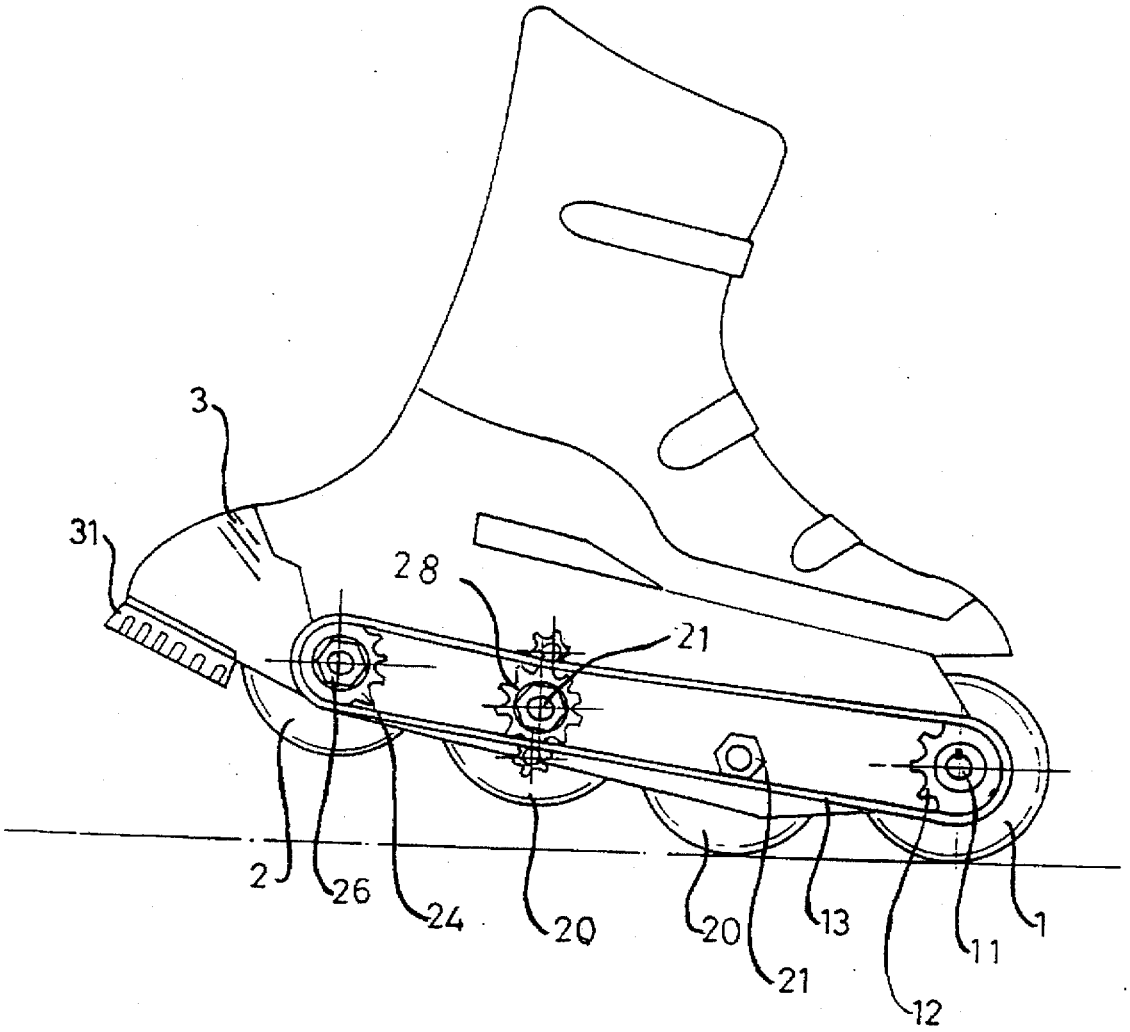
FIG. 5 is a side view showing another application of the roller skate.

As shown in FIG. 5, a further sprocket 28 may further be provided to be secured to an elevated middle wheels 20 and to be coupled to the chain 13 such that the elevated middle wheel may also be driven by the front wheel.

Accordingly, the roller skate in accordance with the present invention includes a rear wheel that may be driven by the front wheel when the rear wheel is elevated and when the rear wheel is not in contact with the ground.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A roller skate comprising:

a body including a lower portion, a front shaft, at least one middle shaft and a rear shaft rotatably supported in said lower portion of said body, a front wheel, at least one middle wheel and a rear wheel secured to said front shaft and said middle shaft and said rear shaft respectively for engaging with a ground surface, said front wheel being arranged to be disengaged from the ground surface when said middle wheel and said rear wheel are in contact with the ground surface, and said rear wheel being arranged to be disengaged from the ground surface when said middle wheel and said front wheel are in contact with the ground surface, and means for coupling said rear wheel to said front wheel so as to allow said rear wheel to be driven by said front wheel when said rear wheel is elevated.

2. A roller skate according to claim 1, wherein said coupling means includes a first sprocket secured to said front shaft so as to be moved in concert with said front wheel, a second sprocket secured to said rear wheel so as to be moved in concert with said rear wheel, and a chain coupling said first and said second sprockets together so as to couple said front wheel and said rear wheel together.

* * * * *